US005235837A

United States Patent [19]

Werner

[11] Patent Number: 5,235,837

[45] Date of Patent: Aug. 17, 1993

[54] FABRICATION OF PRESSURE VESSELS

[75] Inventor: John A. Werner, Milwaukee, Wis.

[73] Assignee: Compression Technologies, Inc., Eden Prairie, Minn.

[21] Appl. No.: 984,595

[22] Filed: Dec. 2, 1992

Related U.S. Application Data

[63] Continuation of Ser. No. 687,629, Apr. 19, 1991.

[51] Int. Cl.[5] ..... B21B 27/06

[52] U.S. Cl. ..... 72/69; 72/84

[58] Field of Search ..... 72/69, 80, 84, 110, 72/85; 29/422; 228/60

[56] References Cited

U.S. PATENT DOCUMENTS

| | | |
|---|---|---|
| 691,727 | 1/1902 | McTear . |
| 729,099 | 5/1903 | Smith . |
| 2,351,020 | 6/1944 | Dewey . |
| 2,388,545 | 11/1945 | Horak . |
| 2,406,059 | 8/1946 | Burch . |
| 2,408,596 | 10/1946 | Bednar et al. . |
| 2,434,737 | 1/1948 | Enghauser . |
| 2,663,206 | 12/1953 | Whiting et al. . |
| 2,726,561 | 12/1955 | Hill . |
| 2,900,712 | 8/1959 | Keating . |
| 3,050,023 | 8/1962 | Brown . |
| 3,380,275 | 4/1968 | McGraw, Jr. . |
| 3,672,317 | 6/1972 | Halling et al. . |
| 3,740,986 | 6/1973 | Schmid . |
| 3,779,060 | 12/1973 | Schroder . |
| 3,793,863 | 2/1974 | Groppini . |
| 3,823,591 | 7/1974 | Schroder et al. . |
| 3,846,886 | 11/1974 | Schroder et al. . |
| 3,874,209 | 4/1975 | Maiorino . |
| 3,926,025 | 12/1975 | Schroder et al. . |
| 3,962,896 | 6/1976 | Bichel . |
| 4,018,072 | 4/1977 | Davis . |
| 4,118,846 | 10/1978 | Korte . |
| 4,238,944 | 12/1980 | Duffy . |
| 4,418,557 | 12/1983 | Halene . |
| 4,502,310 | 3/1985 | Gnutov et al. . |
| 4,711,110 | 12/1987 | Castricum . |
| 4,760,725 | 8/1988 | Halasz . |
| 4,838,064 | 6/1989 | Pass . |

FOREIGN PATENT DOCUMENTS

| | | |
|---|---|---|
| 0081700 | 6/1983 | European Pat. Off. . |
| 0119141 | 3/1984 | European Pat. Off. . |
| 1085657 | 4/1984 | U.S.S.R. . |
| 1423221 | 9/1988 | U.S.S.R. . |

OTHER PUBLICATIONS

"High Performance Machines for Neckforming and Endclosing of Tubular Parts" Model AST, Autospin, Inc. No. 105/30-5-84.

"CNC Controlled Metal Spinning Machines for Forming of Heavy Pieces High Output; High Accuracy and Excellent Surface Finish" Autospin, Inc. No. 154/87-5-15.

"Plant for Manufacture of High Pressure Gas Cylinders", Leifeld u. Co., No. 310/2E-1000-2.84.

*Primary Examiner*—Mark Rosenbaum
*Assistant Examiner*—C. Richard Martin
*Attorney, Agent, or Firm*—Haugen and Nikolai

[57] ABSTRACT

An improved apparatus for the formation and production of cylindrical pressure vessels or tanks through metal spinning operations wherein the end caps of the vessels are simultaneously formed from a hollow, thin-walled cylindrical work tube rotatably supported within the apparatus. The arrangement is further designed to provide control of the distribution of the wall thickness as well as the profile of the end cap portion of the vessel so that the knuckle area may be of controlled thickness to increase durability and performance of the tank or vessel.

6 Claims, 10 Drawing Sheets

FABRICATION OF PRESSURE VESSELS

This is a continuation of copending application Ser. No. 07/687,629, filed on Apr. 19, 1991.

BACKGROUND OF THE INVENTION

The present invention relates generally to an improved apparatus for the formation and production of cylindrical pressure vessels or tanks through metal spinning operations, and more particularly to an apparatus arranged for the production of double-ended vessels through the simultaneous formation and/or creation of end closures along a hollow, thin-walled cylindrical work tube rotatably supported within the apparatus. The apparatus of the present invention is designed to provide and facilitate the rapid production of double-ended pressure vessels whereby the distribution of the wall thickness of the end cap portion of the vessel may be controlled so as to provide a predetermined properly distributed wall thickness which provides zones of increased thickness where desired for durability and improved pressure vessel or tank lifetime or performance.

In the past, pressure vessels or tanks, particularly thin-walled tanks, have been typically fabricated from a central tubular cylindrical body portion to which appropriately designed end caps are secured, typically through welding operations. Such vessels have, of course, been recognized as being suited for a wide variety of fluid retention applications. Because of the requirement of welding end caps to the cylindrical tube portion, the cost of labor and materials in the production of pressure vessels has been a significant factor in their overall cost of production.

SUMMARY OF THE INVENTION

In accordance with the present invention, an apparatus and process is provided which enables the production of double-ended vessels through the simultaneous formation of end closures along a cylindrical work tube, particularly thin-walled tubing. These end closures may also be formed along the pattern and/or design of the commonly accepted and recognized tanks or vessels. For example, the apparatus of the present invention is capable of producing tank ends which are consistent with the ASME designs for high crown, elliptical, and standard code ends, as well as non-code standard ends. The distribution of wall thickness of the tank ends produced by the apparatus of the present invention may be influenced so as to provide greater thickness at the knuckle area (the zone of smallest radius of curvature) so as to create a vessel with greater durability and extended lifetime. For example, it is recognized that the knuckle zone adjacent the end of a pressure vessel is typically the weakest point. In accordance with the apparatus of the present invention, however, a tank end may be formed through a spinning technique wherein the wall thickness in the knuckle zone is made greater than the wall thickness along the remaining portions of the tank. By providing this greater thickness in the tank at and along this area, the overall features such as strength, reliability, and safety of the tank are improved.

As indicated, the apparatus of the present invention renders it possible to fabricate a pressure vessel or tank by a spinning technique wherein the opposed closed ends are simultaneously formed. The availability of such simultaneous treatment significantly reduces the time required for tank fabrication, inasmuch as only one heating-and-cooling cycle is required for the entire end cap fabrication operation. Additionally, the handling normally required is significantly reduced because of the simultaneous end cap formation capability.

Therefore, it is a primary object of the present invention to provide an improved apparatus for the formation of tank ends through a metal spinning process wherein the tanks may be fabricated on an expedited and efficient basis, with the resultant product having improved mechanical properties, including durability and strength.

It is yet a further object of the present invention to provide an apparatus for the production of double-ended pressure vessels or tanks wherein opposed tank ends are simultaneously formed through a metal spinning operation.

Thus, in accordance with the present invention, an apparatus is provided which enables the formation and/or production of tank ends through the simultaneous spinning formation of such ends, and wherein the spinning operation utilizes forming rollers at opposed ends which utilize forces which may vary during an axially outwardly radially inwardly directed forming stroke as contrasted with an axially inwardly radially outwardly directed forming stroke. By controlling the path and rate of motion of the forming rollers, and thus the application of forces in this fashion, it is possible to control the distribution of the wall thickness of the tank end as well as the profile thereof, and accordingly provide greater wall thickness in the knuckle zone of the vessel, this area normally comprising the weakest point of the tank and/or vessel.

It is yet a further object of the present invention to provide an improved apparatus for the production of double-ended pressure vessels or tanks through the simultaneous formation of identically shaped or non-identically shaped end closures utilizing metal spinning techniques, and wherein the forming rollers employed in the spinning operation are designed to move through successive strokes or motion along one or more axes, and wherein the arcuate spacing for each of the individual strokes is controlled so as to appropriately form a tailored wall thickness profile which provides a tank end with added thickness at the knuckle portion thereof.

Other and further objects of the present invention will become apparent to those skilled in the art upon a study of the following specification, appended claims, and accompanying drawings.

IN THE DRAWINGS

Figure 5:
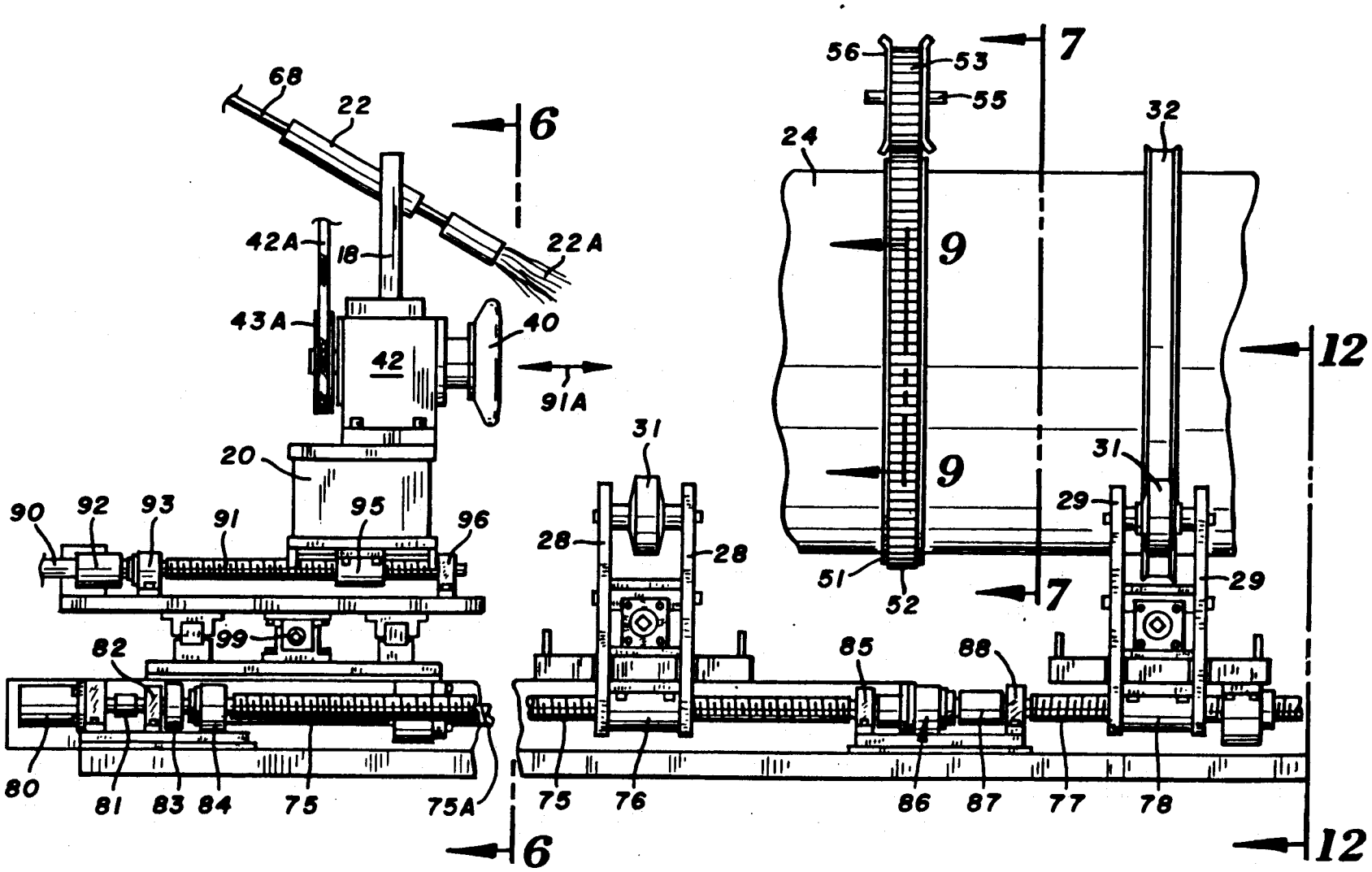
Figure 6:
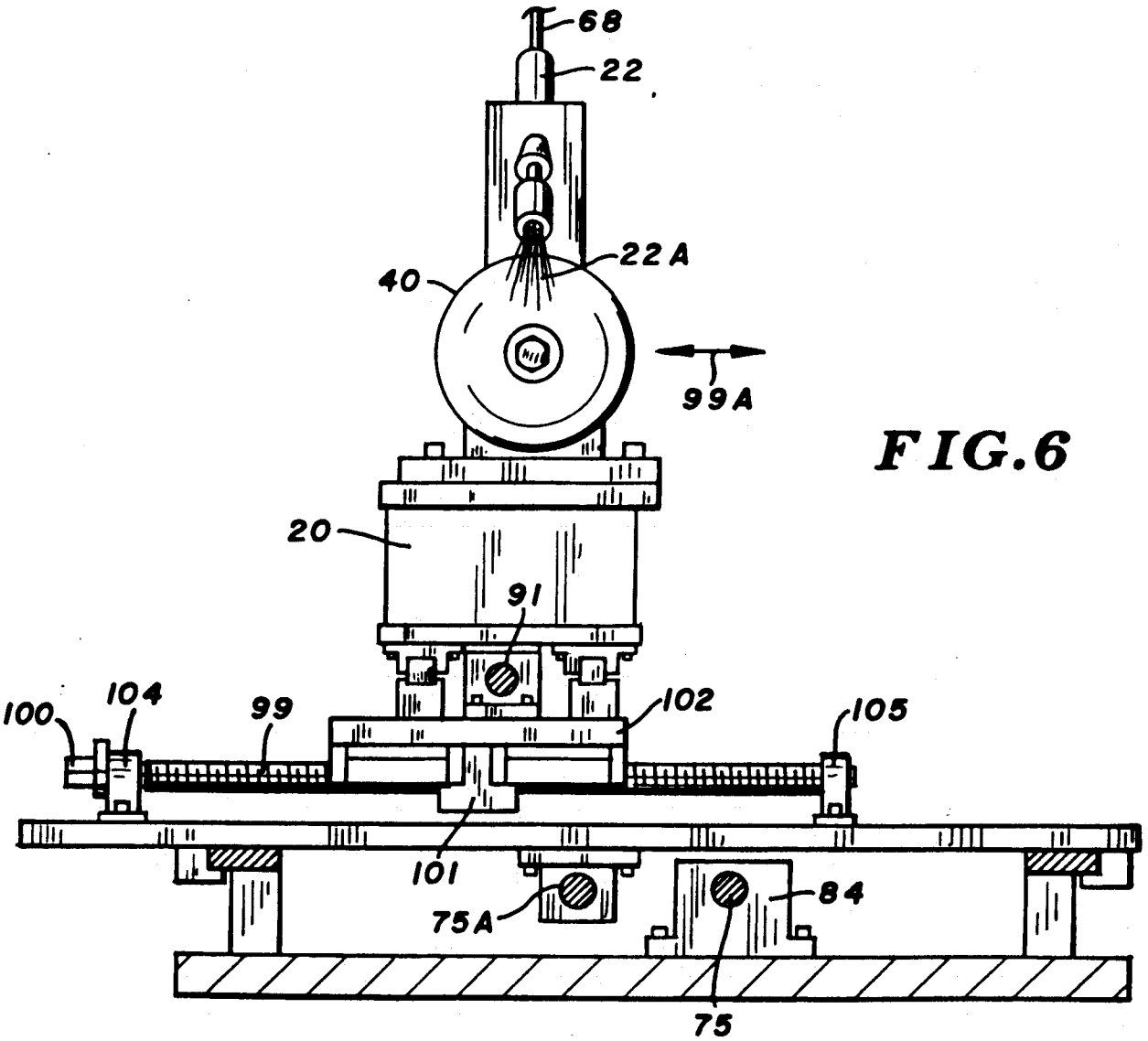
Figure 7:
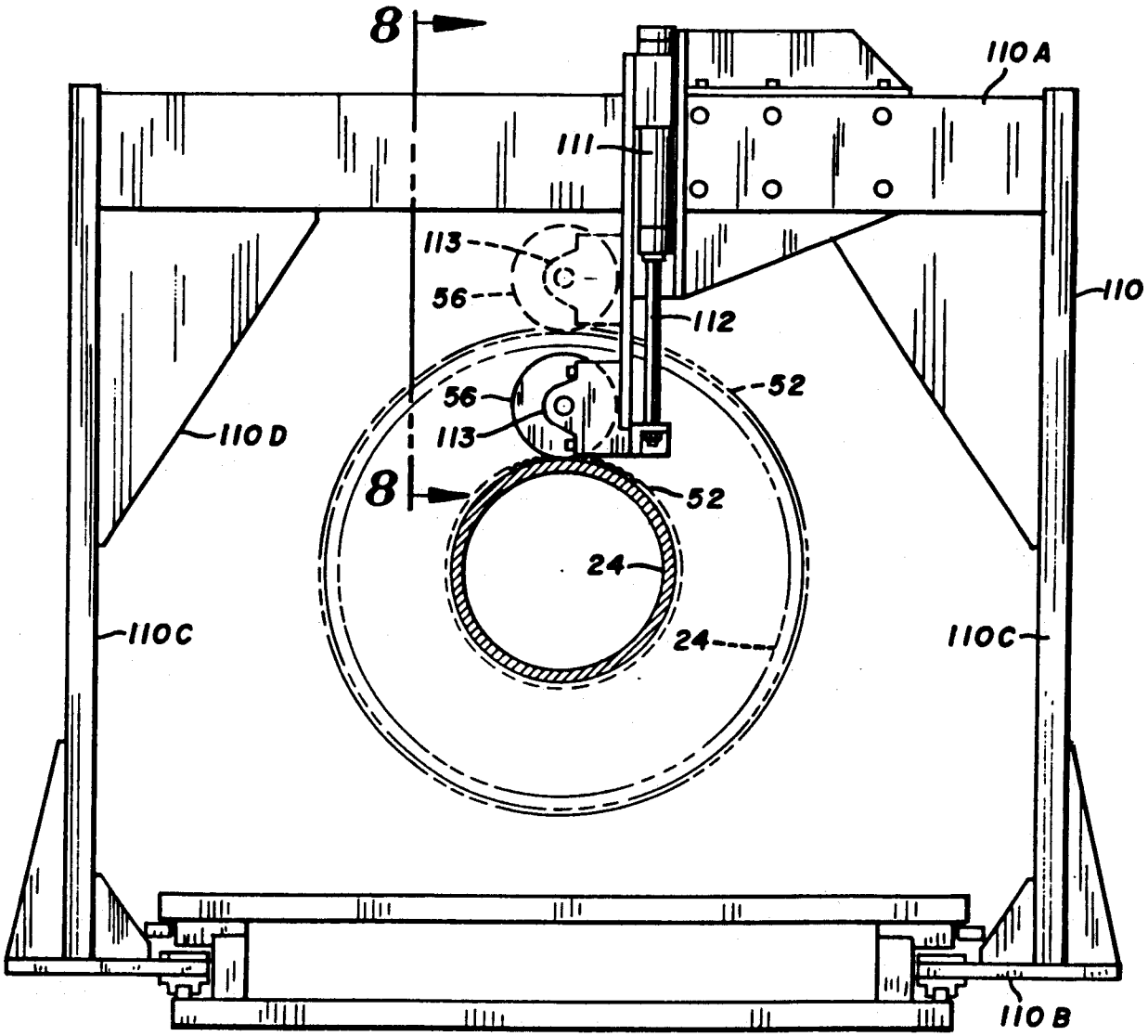
Figure 8:
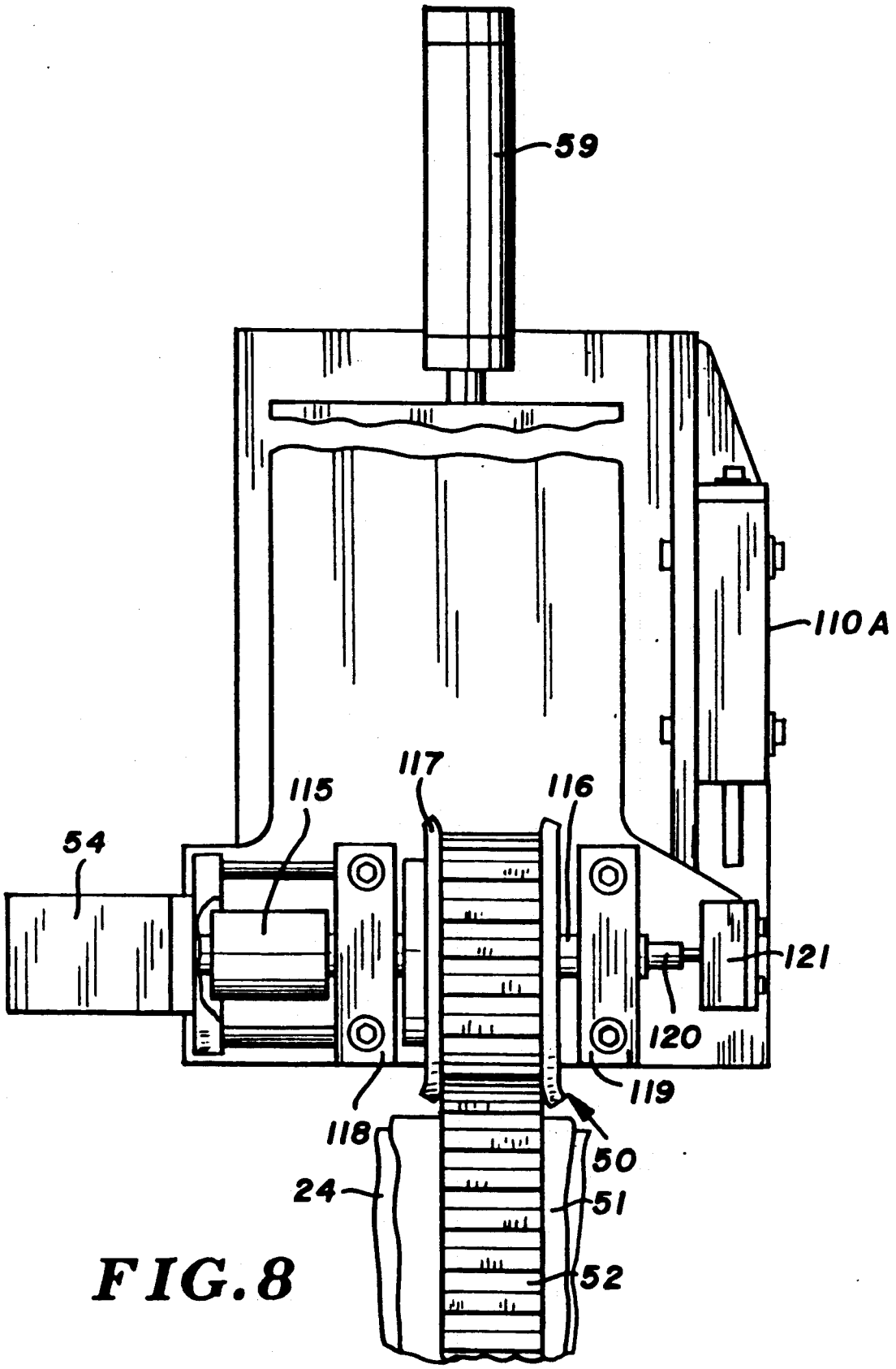
Figure 11A:
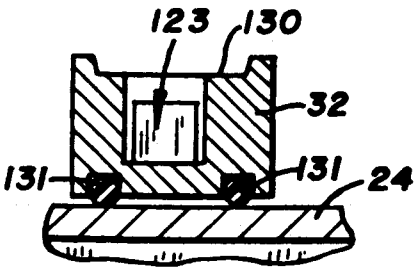
Figure 10:
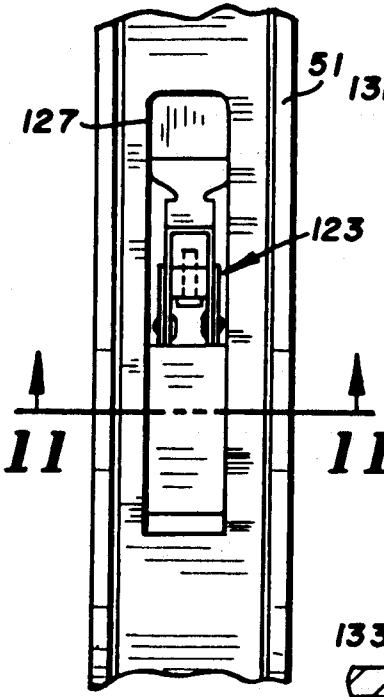
Figure 11B:
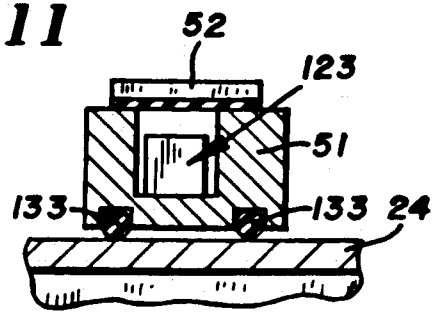
Figure 9:
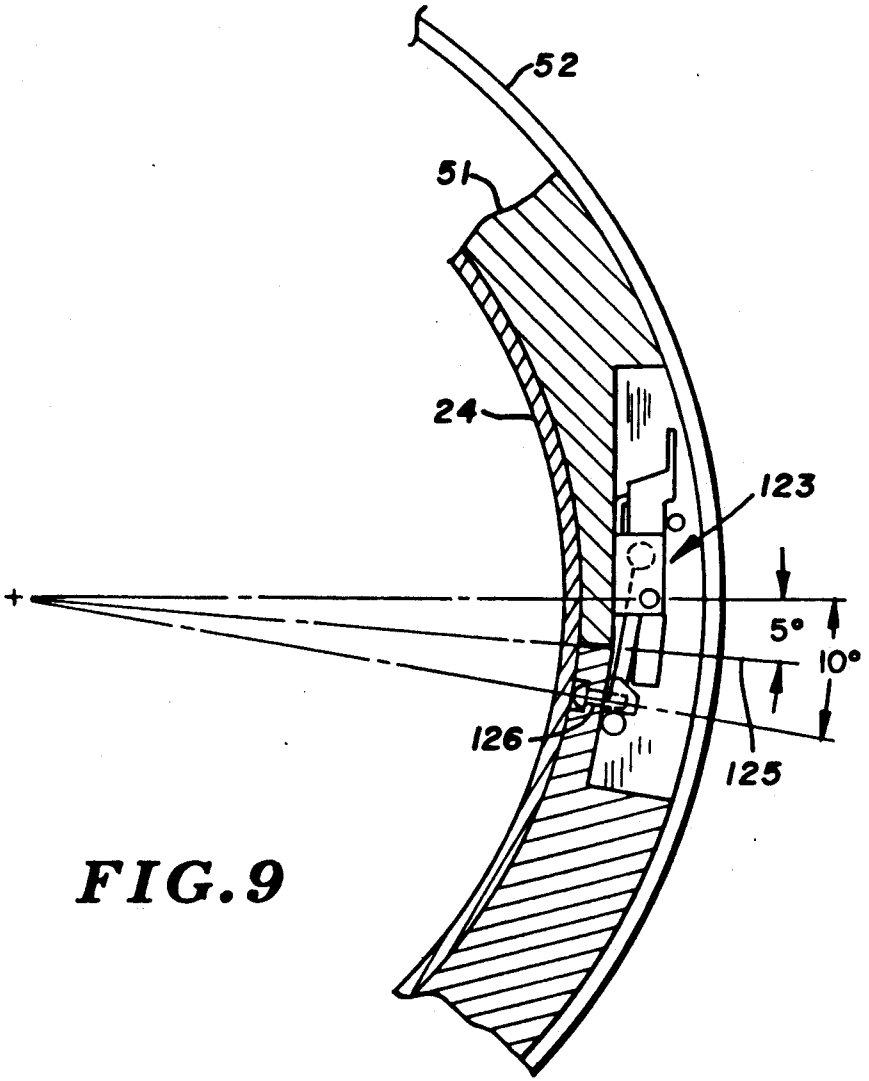
Figure 12:
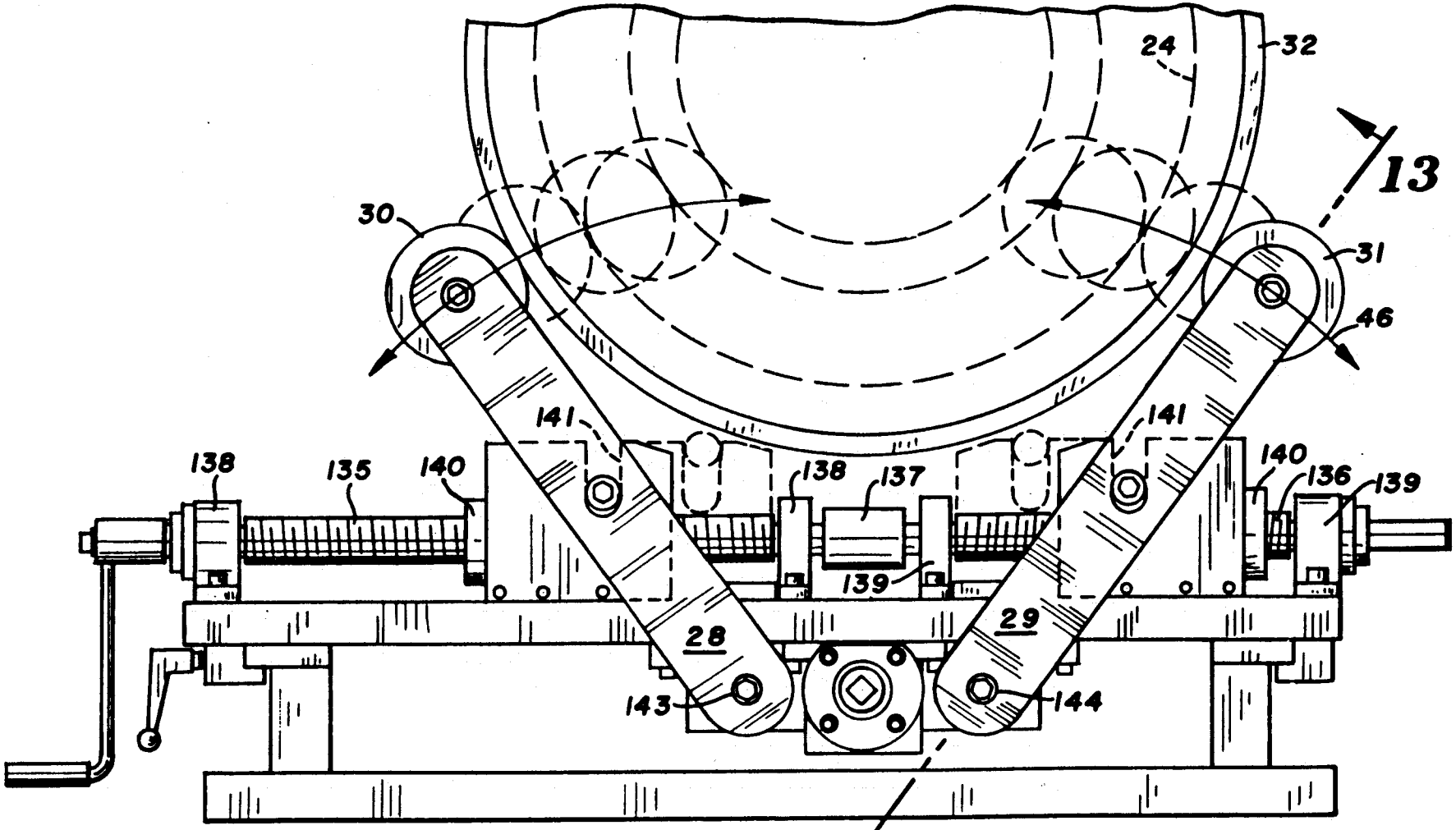
Figure 13:
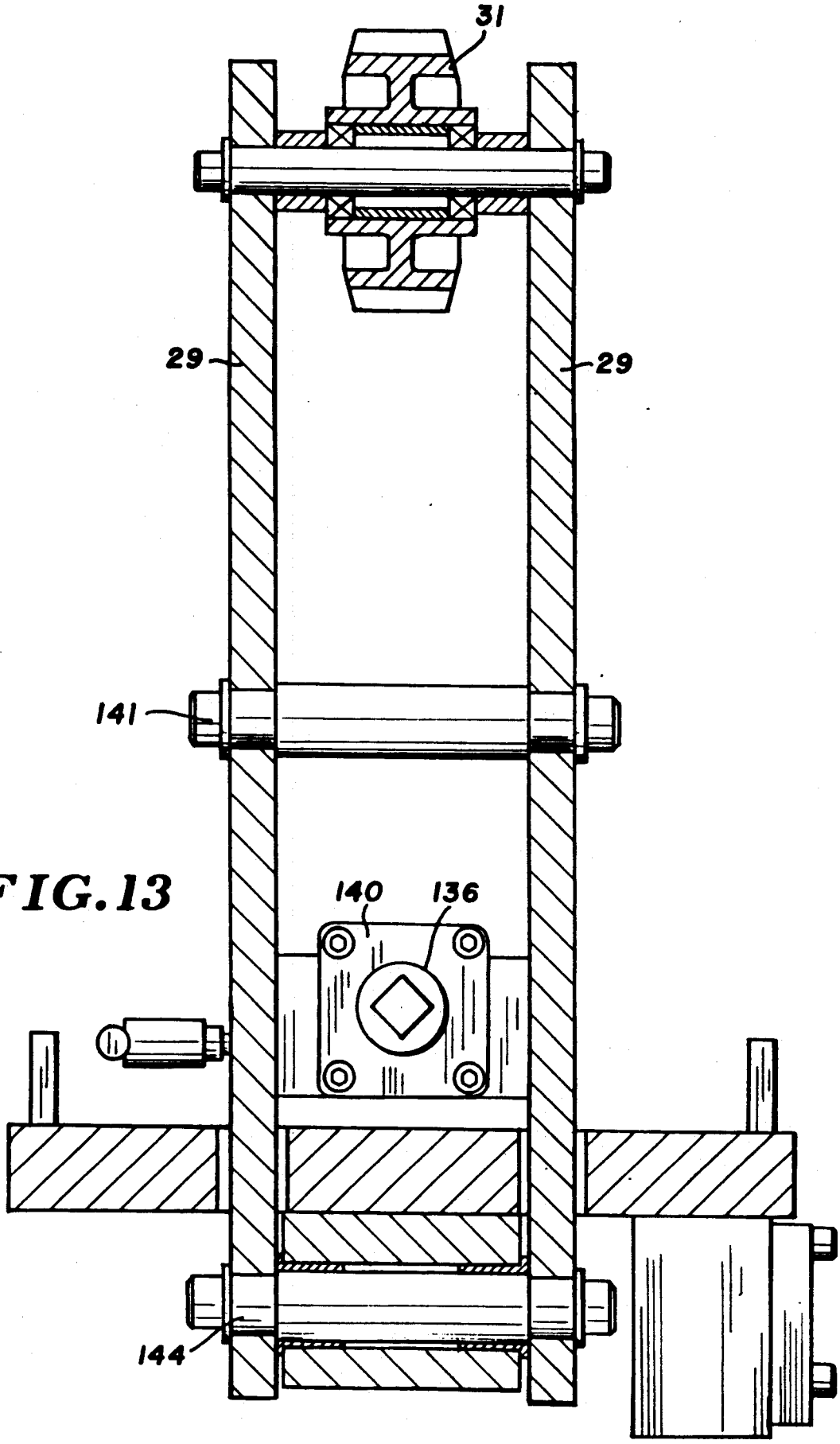

FIG. 5 is a side elevational view of a portion of the apparatus of the present invention, and illustrating a fragmentary portion of a cylindrical work tube retained therewithin, with FIG. 5 further illustrating details of the clamping means, cylindrical work tube drive means, and means for controlling the motion of the forming rollers during formation of the tank ends, and with only a fragmentary portion of the cylindrical work tube being illustrated, the balance being cut away in order to better illustrate the details of the structure;

FIG. 6 is a vertical sectional view taken along the line and in the direction of the arrows 6—6 of FIG. 5;

FIG. 7 is a vertical sectional view taken along the line and in the direction of the arrows 7—7 of FIG. 5;

FIG. 8 is a vertical sectional view taken along the line and in the direction of the arrows 8—8 of FIG. 7, and with FIG. 8 being shown on a slightly enlarged scale;

FIG. 9 is a vertical sectional view taken along the line and in the direction of the arrows 9—9 of FIG. 5 and illustrating certain details of the support and drive rings employed in the apparatus, with the drive belt being removed;

FIG. 10 is an elevational view of the latch mechanism employed in the support and drive ring component shown in FIG. 9;

FIG. 11A is a further view of the grooved support and drive ring, with FIG. 11A being taken along the line and in the direction of the arrows 11—11 of FIG. 10;

FIG. 11B is a view similar to FIG. 11A, and illustrating the timing belt drive ring arrangement employed in the apparatus of the present invention, with the drive belt being removed;

FIG. 12 is a detail end view of the apparatus of the present invention, with FIG. 12 being taken along the line and in the direction of the arrows 12—12 of FIG. 5, with the upper portion of the cylindrical work tube being cut away, and with FIG. 12 being shown on a slightly enlarged scale; and FIG. 13 is a detail sectional View taken along the line and in the direction of the arrows 13—13 of FIG. 12, and illustrating the features of the roller arm supporting the guide rollers for the cylindrical work tube.

DESCRIPTION OF THE PREFERRED EMBODIMENT

Figure 1:
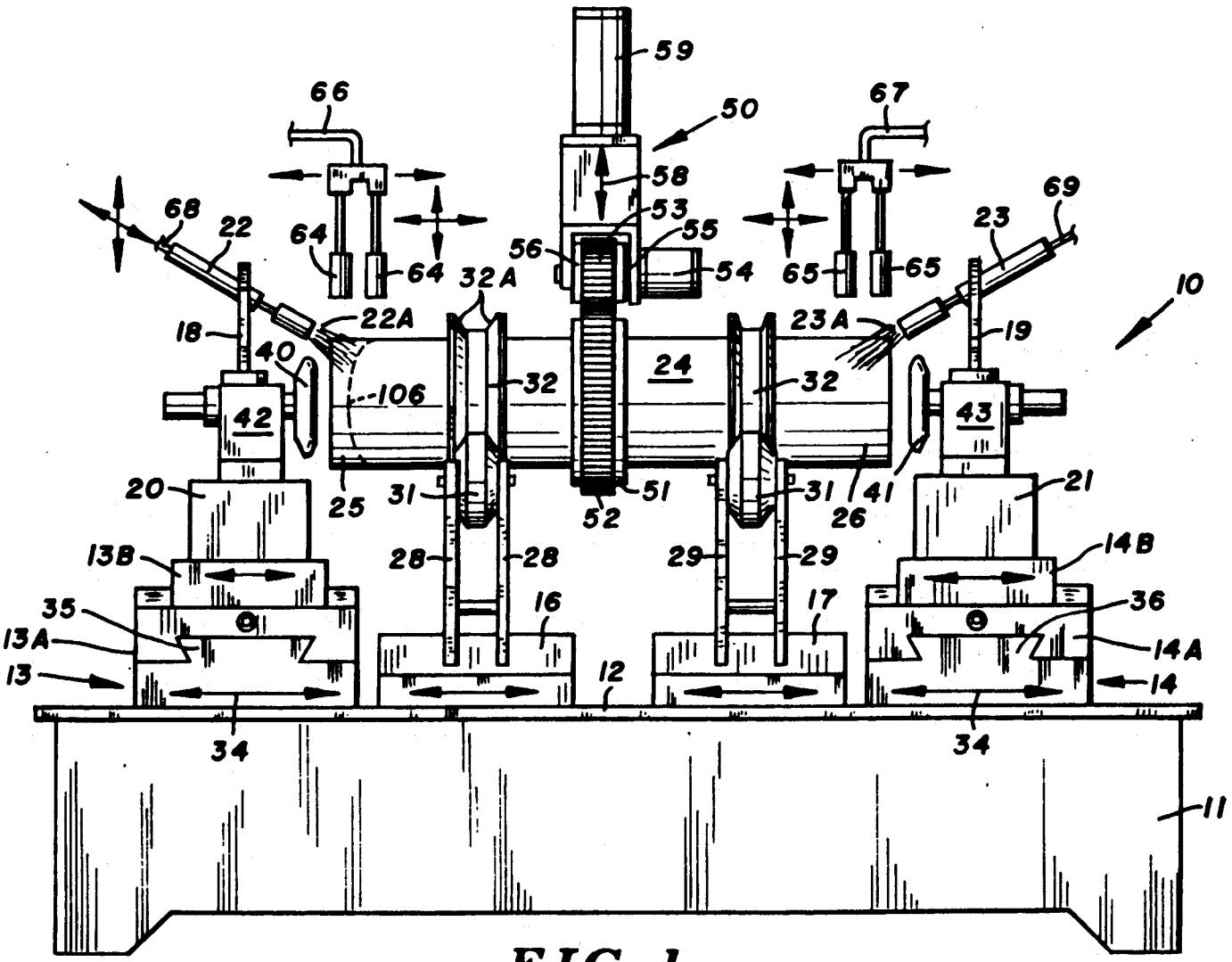
FIG. 1 is a side elevational view of the apparatus of the present invention, and illustrating a cylindrical work tube mounted within the apparatus.
Figure 2:
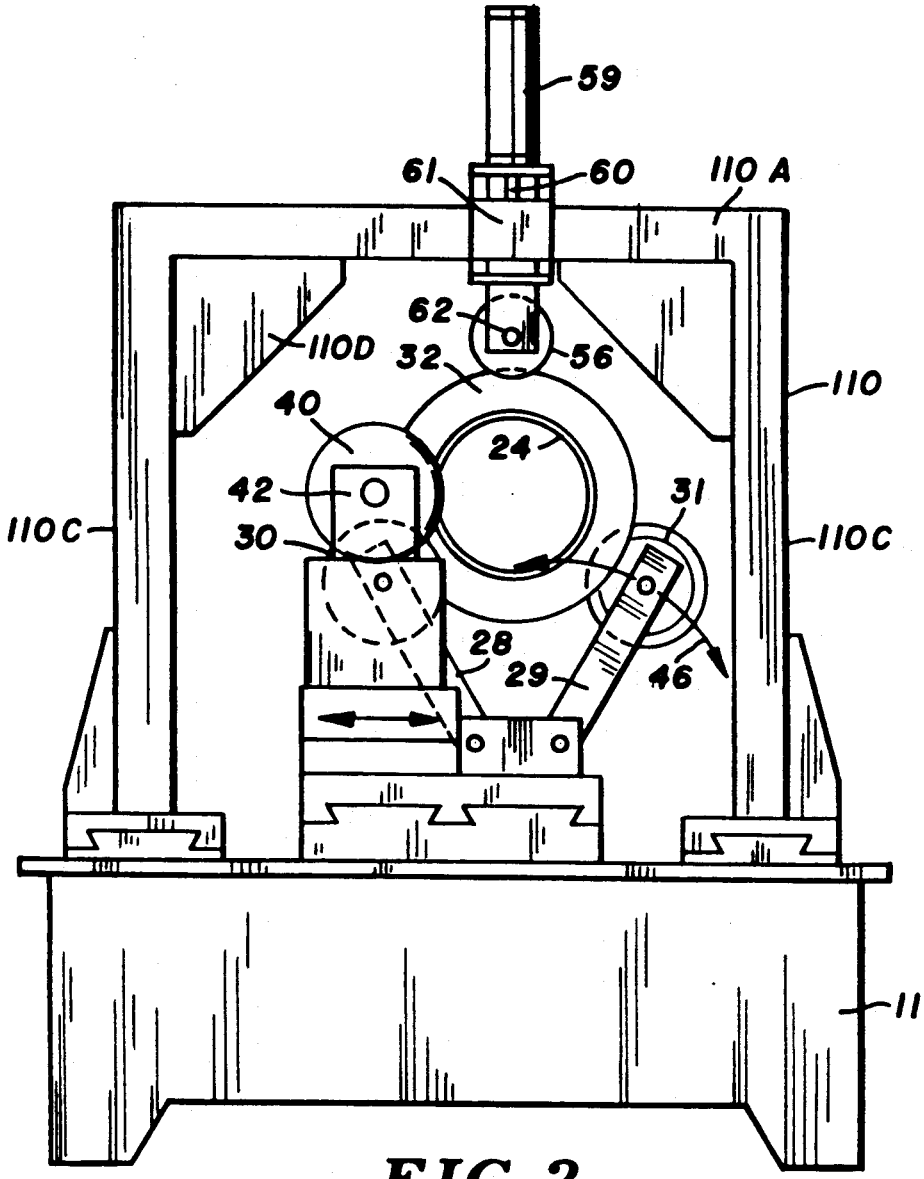
FIG. 2 is an end view of the apparatus illustrated in FIG. 1, and illustrating, partially in phantom, the disposition of the support rollers during the end closure forming operation.
Figure 3:
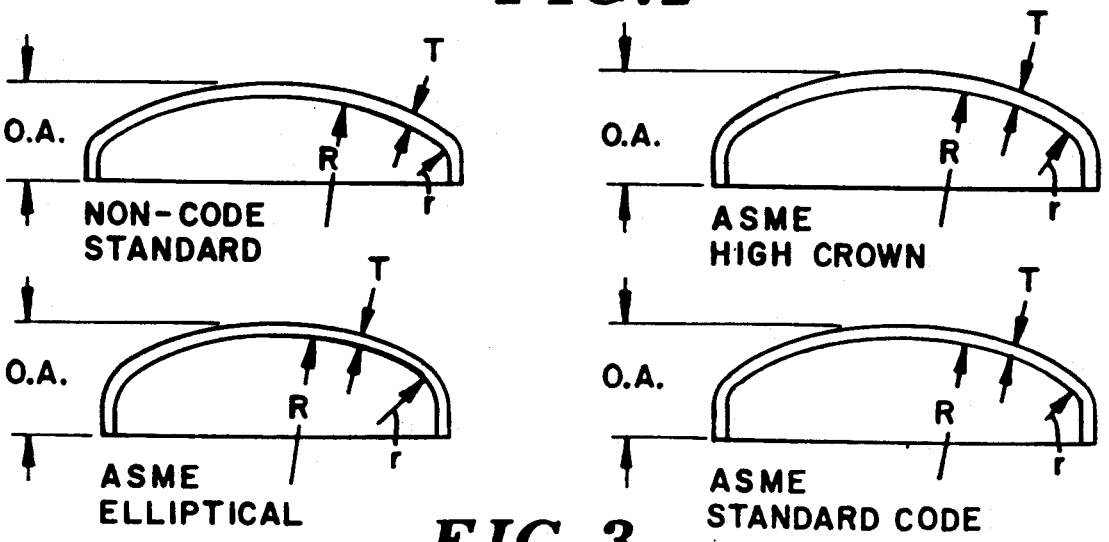
FIG. 3 is a sectional view of typical tank end profiles, and illustrating the configurations thereof.

In accordance with the preferred embodiment of the present invention, and with particular attention being directed to FIGS. 1 and 2 of the drawings, the apparatus for the production of double-ended vessels generally designated 10 comprises frame means 11 including a primary base mounting pad 12 containing an elongated axial guideway or rail along with a plurality of opposed pairs of guideways including a first pair of opposed guideways 13 and 14, along with a second pair of opposed guideways 16 and 17. These guideways are generally equally and oppositely disposed relative to the center of the apparatus 10. Each of the guideways 13 and 14 include a series of superimposed or stacked slidable plates, with guideway 13 including slidable plates 13A, 13B and 13C. Similarly, guideway 14 includes slidable plates 14A, 14B and 14C. Slidable plates 13A and 14A are movable along an axis transverse to the elongated axis of support 11, while plates 13B, 13C, 14B and 14C are each movable along axes parallel to the elongated axis of support 11. In order to permit full expansion of the system to accommodate tanks of various lengths, it has been found useful to incorporate plural slidable pads movable along the same axis, such as pads or plates 13B and 13C, along with opposed pads 14B and 14C. In this fashion, pads 13C and 14C may be used for establishing a static set-up dimensional placement for the device, while plates 13B and 14B may be utilized for establishing a fine tuning or dynamic adjustment. Heating torch articulating means 18 and 19 are provided at each end of the production apparatus 10, with the torch articulating means 18 and 19 being secured to a first opposed pair of secondary base mounting pads 20 and 21. Means are provided for adjustably securing a heating torch to the articulating means, with heating torches being illustrated as at 22 and 23 respectively. As will be indicated hereinafter, secondary base mounting pads 20 and 21 are arranged to support, articulate, and control the programmed movement of the tube forming rollers employed in the spinning operation.

With continued attention being directed to the heating torches, and as indicated in FIG. 1, a flame is shown schematically at 22A and 23A, with these flames being directed toward and impinging directly upon the surface of cylindrical work tube generally designated 24. As indicated, flames emitted from heating torches 22 and 23 impinge upon ends portions 25 and 26 respectively of cylindrical work tube 24.

With continued attention being directed to FIG. 1 of the drawings, cylindrical work tube guide arms 28 and 29 are each secured to a second opposed pair of secondary base mounting pads 16 and 17, with the cylindrical work tube guide means being adapted to adjustably and releasably position the cylindrical work tube 24 within the apparatus 10. As is apparent from the view of FIG. 2, cylindrical work tube guide means, including guide rollers 30 and 31 are arranged to guidingly contact guide ring 32, at spaced arcuate dispositions therealong. In the end view of FIG. 2, the guide ring 32 is disposed about the outer periphery of cylindrical work tube 24.

As is apparent in FIGS. 1 and 2, guideways 13 and 14 are designed for accommodating linear motion along a pair of axes, as illustrated in double-headed arrows 34—34 (FIG. 1), along with guideways 35 and 36, also illustrated in FIG. 1. Thus, primary base mounting pad assemblies 13 and 14 are designed to accommodate linear or translatory motion along two axes arranged at right angles, one to the other.

The heating torch articulating means is illustrated in FIGS. 1 and 2, particularly with movement available from guideways 34, 35, and 36. In this connection, both the heating torches 22 and 23, along with forming members such as forming rollers 40 and 41 are designed to move along those two axes for the base pads 13 and 14. Thus, the heating torch articulating means and the forming rollers move as a unit, thereby providing for ease of control of temperature of that portion of the cylindrical work tube 24 being subjected to the metal spinning operation.

Figure 4:
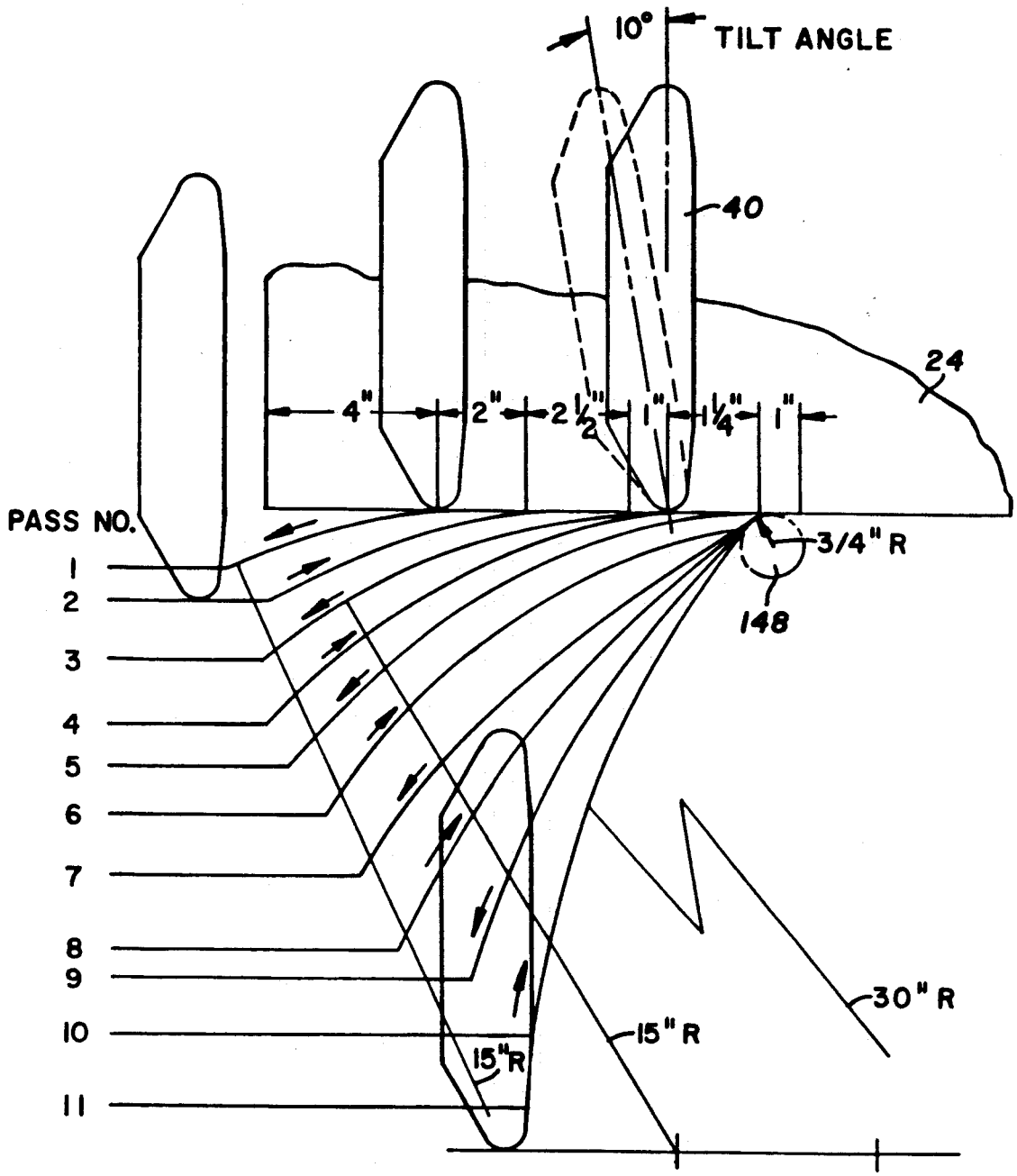
FIG. 4 is a schematic view of various positions occupied by forming rollers during the operations of the apparatus of the present invention, and further illustrating the typical arcuate paths followed during individual passes followed and/or undertaken by the forming rollers.

With attention being directed to FIG. 2 of the drawings, it is sometimes desirable to provide a means for rotating forming rollers such as forming rollers 40 and 41. Variable speed motors are provided as at 42 and 43, with the motor speed being designed to rotate forming rollers 40 and 41 to provide substantially matching rates of speed between the contacting surfaces of work tube 24 and forming rollers 40 and 41 regardless of radial disposition, thus avoiding galling. In lieu of the variable speed motors 42 and 43, a belt drive from a remote motor may be employed to rotate forming rollers 40 and 41 at appropriate speeds. A belt and pulley arrangement is illustrated in FIG. 5, such as at 42A and 43A. Rollers 40 and 41 may be rotated about the vertical axis of member 42 if desired and as indicated in FIG. 4.

As is further apparent from the view of FIG. 2, guide rollers 30 and 31 are adapted to be adjustably positioned in accordance with the double-ended arrow 46. By controlling the angular disposition of guide support arms 28 and 29, the appropriate working height for work tube 24 is provided. As the angular disposition between guide arms 28 and 29 is increased, the tube axis is moved downwardly and larger diameter work tubes may be introduced into the apparatus and subjected to metal spinning operations therewithin.

With continued attention being directed to FIGS. 1 and 2 of the drawings, it will be observed that cylindrical work tube drive and gripping means are arranged as shown generally at 50, with the work tube drive and gripping means being located or positioned generally intermediate of the production apparatus 10, and between opposed pads 20 and 21. Tube drive and gripping means include a hinged guide ring 51 in which there is received a segmented or split spur gear 52. Gear 52 may be in the form of an inverted timing belt, and is arranged to mesh with a second gear as at 53. Gear 53 may also be an inverted timing belt. Hydraulic motor 54 is designed to provide the rotational energy through its output shaft 55 to drive cylinder 56 within which gear 53 is retained. Means are provided for adjustably positioning drive and gripping means 50 along the axis indicated by double-ended arrow 58. Position adjusting means are shown as at 59, with this position adjustment means 59 preferably being in the form of a hydraulic cylinder having a positioning ram as at 60. The extension of ram 60 will, of course, determine the position of drive gear or belt retaining cylinder 56. Suitable guide and frame means are provided for cylinder 59, as at 61. As is indicated, cylinder 56 is journably supported within retaining brackets 62. Cooling means such as water discharge may be used to protect the holdings means 131—131 and 133—133.

As shown in the drawings, particularly in FIG. 1, heat for the spinning operation is normally provided through heating torches 22 and 23. For applications on smaller diameter vessels, a single heating torch at each end may prove to be adequate. In the event supplemental heat is reasonably required in the metal spinning operation, additional heating torches may be provided as at 64—64 and 65—65. A supply of gas for the auxiliary torches is further indicated as at 66 and 67. Similarly, gas supply for main heating torches 22 and 23 may be provided as at 68 and 69. Cooling means in the form of water spray jets may be positioned adjacent to tank ends for added temperature control.

Attention is now directed to FIGS. 5 and 6 for an explanation of the articulating and/or motion-control mechanisms for pads 20 and 21, and accordingly forming rollers 40 and 41, as well as the details of the guide rollers 30 and 31 (see FIG. 2). With respect to the guide roller mechanisms, including support arms 28 and 29, the axial location or position of these members is made possible by means of the rotatably mounted threaded shaft 75 working within nut 76. With continued reference to FIG. 6, shaft 75A (which may be provided with both right and left hand threaded portions) is designed to control the disposition of pad or plate 13C, and thus assist in the overall positioning of certain components within the assembly. Nut 76 is secured to arms 28—28, and rotation of shaft 75 in turn controls the axial disposition of arms 28 and 29 and rollers 30 and 31. Correspondingly, the opposed end of the system is provided with threaded shafts 77 and 77A together with nut assemblies such as at 78 for controlling the axial disposition of support roll 31 and its mating guide roll on the opposed side of the cylinder 24. Shaft 77A (not shown) is utilized in connection with the positioning of pad or plate 14C Guide rolls 30 and 31, together with the corresponding pair of guide rolls (one of which is indicated at 31) adjustably cradle and support the cylinder 24 for controlled rotation about its longitudinal axis.

Turning again to the details of the positioning assembly illustrated in FIG. 5, hydraulic motor 80 is coupled to threaded shaft 75 through coupling 81. Shaft 75 is mounted for rotation within bearing assembly 82, and includes an extension of threaded shaft 75 through aligning member 83. A bearing block is indicated at 84 for preventing axial motion in the rotation of shaft 75. The opposed end of shaft 75 is received within bearing block 85, and ultimately within coupling assembly generally shown at 86, along with coupling sleeve 87 joining shafts 75 and 77, one to the other. A second bearing block is provided for shaft 77 as at 88.

Thus, rotational motion of hydraulic motor 80 causes rotation of oppositely threaded shafts 75 and 77 to occur in unison, thereby controlling and expediting the positioning of guide rolls 31—31, along with its mating rolls 30—30 disposed on the concealed portion of the view of FIG. 5.

In order to provide fine adjustment and operating motion for the forming roller 40, a computer controlled operating drive means (not shown) is provided for shaft segment 90 coupled to threaded shaft 91 at coupling member 92. Bearing 93 is provided to enable appropriate rotation of shaft 91 and corresponding axial motion of secondary mounting pad 20 through nut assembly 95. An additional bearing is provided as at 96 to support the rotation of shaft 91. Accordingly, it will be observed that the static adjustment X-axis motion of forming rollers 40 and 41 is controlled through rotation of shafts 75A and 77A together with their respective mating nut assemblies.

Turning now to the detail shown in FIG. 6, the Y-axis motion (99A) is created through rotation of threaded shaft 99, with rotation of threaded shaft 99 being made possible through shaft extension 100 which is coupled to a motor (not shown). Nut assembly 101 is utilized to provide motion directly to mounting plate 102 as indicated in FIG. 6. Accordingly, as the threaded shaft 99 is rotated within bearings 104 and 105, nut assembly 101 causes linear motion to occur on mounting plate 102. As is indicated, shaft 99 is disposed at right angles to shaft 91, and thus appropriate motion in desired directions may be obtained through controlled rotation of shafts 91 and 99 and their counterparts. As will be apparent, the oppositely disposed portion mounted upon and coupled to secondary base mounting pad 21 is a mirror image of that arrangement illustrated in FIG. 6. In other words, the apparatus is provided with oppositely disposed pairs of metal spinning apparatus.

Appropriate programmed control may be coupled to the motor means utilized to drive shafts 91 and 99 and their counterparts. See double-ended arrows 91A (FIG. 5) and 99A (FIG. 6) indicating this motion. By appropriately programming the motion or through the use of servo controlled motors, a family of excursions may be designed for forming roller 40. These excursions are designed to perform the necessary metal spinning and formation operations which will ultimately close the end of tube 24, and form a closed end as illustrated in phantom in FIG. 1 at 106.

Attention is now directed to FIGS. 7 and 8 of the drawings which illustrates the drive mechanism, including the cylindrical work tube drive and gripping means 50. Frame means 110 includes upper and lower cross-members 110A and 110B. Posts 110—110C are provided with reinforcing gussets, as indicated for example at 110D. Appropriate corner braces are provided in order to provide overall stability to frame means 110. In this arrangement, frame means 110 supports hydraulic cylinder 111 having a slide or ram 112 coupled thereto, with cylinder 111 being, of course, a double-acting cylinder. Secured to the distal end of slide or ram 112 is a clevis arrangement 113 to which is mounted hydraulic motor 54. Rotation of the output shaft of motor 54, as indicated, drives member 56 which is, in turn, in mesh with gear 52. Vertical adjustment is provided by ram 112 in order to accommodate and treat tanks of different diameters.

Attention is now directed to FIG. 8 which illustrates further details of the drive mechanism for rotating the cylindrical work cylinder. Hydraulic motor 54 is coupled through coupling element 115 to shaft 116 to which drive member 117 is arranged in fast relationship. Appropriate bearings are provided at 118 and 119 to accommodate rotational motion of shaft 116. A secondary coupling is provided along shaft 116 as at 120 for obtaining data from encoder 121. Encoder 121 is designed to provide position feedback data to the system, and also to provide for controllable rotational motion to the components system, with suitable encoders being, of course, commercially available. In certain applications, hydraulic cylinder 111 may be an air cylinder, if desired.

In order to appropriately program the X-Y motion of the forming roller 40, programmed computer servo controlled motors may be employed. Also, the motion control means handling the positioning of forming rollers, such as roller 40 are desirably coordinated with the rotational speed of the tank so that lineal rates of motion between the surface of the tank and roller 40 are substantially matching.

With attention now being directed to FIG. 9, latch system generally designated 123 is provided in order to tightly grip drive ring 51 about the outer periphery of cylindrical work tube 24. Latch system 123 is coupled on either side of parting line 125 in order to achieve appropriate gripping relationship of ring 51 about tube 24. In most instances, drive ring 51 utilizes latch member 123 with gripping element 126, and with an arcuate spacing of 5 degrees on either side of the parting line, for example, being designated as appropriate for stable gripping force. The angular relationship is illustrated in FIG. 9.

With attention now being directed to FIG. 10, further details of the latch mechanism are illustrated. In this arrangement it can be seen that latch system 123 includes a toggle lever 127 for achieving appropriate closure arrangements.

FIG. 11A illustrates the detail of guide ring 32. Guide ring 32 is provided with a channel zone as at 130 to receive roller supports 30—30 and 31—31 therewithin. Guide rings 32—32 along with rollers such as at 30—30 and 31—31 complete that portion of the assembly. Suitable O-rings are provided, such as at 131 for providing resilient gripping between member 32 and the outer periphery of cylinder tube 24. Latching mechanism 123 is illustrated in both FIGS. 11A and 11B. For operational expediency, only one guide ring of the type shown in this FIG. 11A need be employed, with the second or opposed guide being in the form of a flat ring or short cylinder, without flanges 32A—32A being required to be present. Of course, for stability of operation, it may in certain instances be desirable to utilize a dual set of flanged members such as are illustrated at 32—32 in FIG. 1.

FIG. 11B is similar to FIG. 11A, but illustrating the detail of drive ring 51. Drive ring 51 may be provided with spur gear or timing belt 52 about the outer periphery thereof, with belt 52 being a timing belt with the drive teeth turned out. A latch mechanism such as shown generally at 123 is provided in a manner similar to that shown in FIG. 9, with a small access hole being cut out of the gear or belt. Also, O-rings are provided as at 133—133 to achieve appropriate snug gripping between drive ring 51 and the outer periphery of cylinder tube 24.

It has been observed that the arrangement of the present invention renders it possible to work with cylindrical work tubes of different diameters. For example, tube 24 may have a diameter ranging from between about 12" and 30", with larger or smaller tubes being appropriate as well. Accordingly, drive ring 51 along with other support rings, such as ring 32 may be fabricated in a family of rings so as to render it possible to work with tubes of different diameter. Thus, cylinder 59 may be utilized to both adjustably accommodate the tubes being treated, as well as to maintain a drive force on the surface of the tube so as to achieve constant, predictable, and reliable rotation thereof. Such rotation is, of course, desired in view of the manner in which force is applied to the forming rollers as they move across the metallic work being spun and/or rotated.

Attention is now directed to FIG. 12 of the drawings wherein the support arrangement for the cylinder tube 24 is shown. Specifically, support rollers 30 and 31 are designed to provide a cradle mechanism for the tube 24, and the arcuate spacing between support rollers 30 and 31 is controlled by a pair of right-hand and left-hand threaded shafts 135 and 136. Shafts 135 and 136 are right-hand and left-hand threaded segments respectively, and are joined together at coupling 137. Bearing blocks are provided as at 138—138 for shaft segment 135, and at 139—139 for shaft segment 136. Nut assemblies are provided as at 140—140 to provide appropriate spacing, and thus angular disposition, with pin retention slots being provided at 141—141 to achieve angular control of arms 28 and 29.

Attention is now directed to FIG. 13 of the drawings wherein a further view of the details of the system described in FIG. 12 are illustrated. In the arrangement of FIG. 13, arm 29 is designed to pivot about its mount 144 and thus achieve appropriate location to provide cradle support for cylindrical work tube 24.

Attention is now directed to FIG. 4 of the drawings wherein a typical family of curves are provided for illustrating the traversing and/or sweeping routes of travel of cylindrical work tube forming rollers 40 and 41. In the schematic illustration of FIG. 4, forming roller 40 typically travels about an arcuate path from a point along the outer periphery of tube 24 to the termination of Pass No. 1, where indicated. Pass No. 1 is achieved on a 15" radius, with the motion and other movement of forming roller 40 being achieved by combined and coordinated movement of the X and Y axes control. For Pass No. 2, forming roller 40 traverses the path or track identified as Pass No. 2 for return to a position adjacent the outer periphery of tube 24. Similarly, further passes are made, as indicated, until the final pass is achieved as defined along Pass No. 11. A 30" radius is normally utilized at Pass No. 11, in order to achieve the appropriate configuration for the tank end. The knuckle zone is designed, for a vessel of 30" diameter to be ⅜", as indicated in FIG. 4.

In the event it is desired to employ a modified tilt angle for forming roller 40 as about vertical axis 42, this may be achieved as shown in phantom in FIG. 4. A tilt angle of 10 degrees may, in certain instances, provide enhanced performance of the system.

In the event continuous duty apparatus is contemplated, it may in certain instances be desirable to provide a liquid coolant for the forming rollers, including forming roller 40. Liquid coolant may be interposed into the confines of forming roller 40 so as to achieve cooling as desired. In this arrangement, suitable rotary couplings are provided in order to preserve the flow of liquid coolant such as water through the interior of the forming rollers, such as forming roller 40. In order to form the final closure along the axis of the tank at opposed ends thereof, a conventional gas torch may be utilized to heat the metal at and along the juncture point, whereupon the metal flows inwardly to seal the tank closure tight. Such techniques are, of course, known in the art and are commonly practiced by skilled artisans.

By way of summary and conclusion, therefore, it will be appreciated that the apparatus illustrated and described hereinabove provides a means for achieving formation of tank ends for cylindrical pressure vessels by utilizing the tank material from an original cylindrical tube. The sequential excursions or sweeping of the forming rollers as indicated in FIG. 4 are undertaken on a basis that the force applied to the forming rollers during a stroke moving axially outwardly may be more or less or equal to that applied during a stroke moving axially inwardly of the tube being treated. In this fashion, a substantial portion of the inwardly directed arcuate strokes will be undertaken at a rate which is either greater, less than, or equal to that applied during the axially outwardly directed stroke. By controlled programming of the motion or position of pads 40, or forces applied thereto and temperature of the work, control and distribution of the metal thickness in the head area may be achieved, particularly in the knuckle area illustrated at 148 in FIG. 4. Rotational rates of speed for the work (tank) may be varied to maintain a substantially matching rate of speed at the forming roller-tank surface interface. Increasing the rotational velocity of the tank as the forming roller 40 moves radially inwardly achieves this result and also increases production rates through a reduction in cycle time.

It will be appreciated, therefore, that the details provided herein are given for purposes of illustration only and not to be construed as a limitation upon the scope of the appended claims.

What is claimed is:

1. Apparatus for the production of double-ended vessels through the simultaneous formation of end closures to a cylindrical work tube and comprising:

(a) frame means including a primary base mounting pad, a plurality of opposed pairs of guideways mounted upon said base pad for accommodating linear motion along at least one axis and with each guideway having a secondary base mounting pad thereon;

(b) cylindrical work tube guide means secured to each of an opposed pair of secondary base mounting pads for adjustably and releasably placing a cylindrical work tube thereon and having means for accommodating rotation of a cylindrical work tube about its tubular axis;

(c) cylindrical work tube drive and gripping means arranged along said work tube intermediate said secondary base mounting pads for providing rotation of said cylindrical work tube disposed within said cylindrical work tube guide means;

(d) heating source means and means for adjustably positioning said heating source relative to and adjacent a work tube being held within said cylindrical work tube guide means;

(e) cylindrical work tube forming rollers secured to a third opposed pair of said secondary base mounting pads and arranged for linear motion about first and second axes disposed at right angles, one to the other, and with said work tube forming rollers being provided with further means for accommodating pivotal rotation about a third axis arranged at right angles to said first and second axes, said cylindrical work tube forming rollers thereby being provided with means for movement along a plurality of arcuate stroking paths between proximal, distal, and radially inwardly and outwardly disposed end points relative to said tubular axis and with said arcuate paths traveling along one of a predetermined series of arcuately spaced-apart paths with certain successive arcuate paths of travel of said predetermined series converging upon said tubular axis toward the distal end point thereof; and (f) means for adjusting the arcuate spacing of successive strokes of motion wherein the arcuate spacing for each individual stroke of axial outwardly radially inwardly directed motion and the magnitude of force applied to said forming rollers is selectively different from its preceding axially inwardly radially outwardly directed stroke, the arrangement being such that the motion applied to said forming rollers during a substantial portion of said axially inwardly radially outwardly directed arcuate strokes is controllably related to that of its immediate preceding axially outwardly radially inwardly directed arcuate stroke by always being greater than, less than, or equal to that of said immediately preceding axially outwardly radially inwardly directed arcuate stroke.

2. The apparatus as set forth in claim 1 being particularly characterized in that the rate of motion of said forming rollers during a substantial portion of said axially inwardly radially outwardly directed arcuate strokes differs from the rate of motion of its immediately preceding axially outwardly radially inwardly directed arcuate stroke by always being greater than or by always being less than that of said immediately preceding axially outwardly radially inwardly directed arcuate stroke.

3. The apparatus as defined in claim 1 being particularly characterized in that cooling means are provided for said cylindrical work tube along said tubular axis at a point intermediate said cylindrical work tube drive and gripping means and each of the secondary base mounting pads of said first opposed pair of secondary base mounting pads.

4. The apparatus as set forth in claim 1 being particularly characterized in that motor means are provided for rotating said cylindrical work tube and said forming rollers at rates dependent upon radial disposition of said roller relative to the vessel axis, the arrangement being such that relative rates of motion between the surface of said vessel and said forming rollers remain substantially matching.

5. The apparatus as defined in claim 1 being particularly characterized in that said heating source comprises a heating torch and wherein said heating torch is associated with articulating means secured to each of a first opposed pair of said secondary base mounting pads and means for adjustably securing said heating torch thereto.

6. Apparatus for the production of double-ended vessels through the formation of end closures to a cylindrical work tube and comprising:

(a) frame means including a primary base mounting pad, a plurality of opposed pairs of guideways for accommodating linear motion along at least one axis and with each guideway having a secondary base mounting pad thereon;

(b) cylindrical work tube guide means secured to each of a second opposed pair of said secondary base mounting pads for adjustably and releasably placing a cylindrical work tube thereon and having means for accommodating rotation of a cylindrical work tube about its tubular axis;

(c) cylindrical work tube drive and gripping means arranged along said primary base mounting means intermediate said first pair of secondary base mounting pads for providing rotation of a cylindrical work tube disposed within said cylindrical work tube guide means;

(d) heating source means and means for adjustably positioning said heating source relative to said work tube while said work tube is held within said cylindrical work tube drive and gripping means;

(e) cylindrical work tube forming rollers secured to a pair of opposed base mounting pads and arranged for linear motion about first and second axes disposed at right angles, one to the other, and with said work tube forming rollers being provided with further means for accommodating pivotal rotation about a third axis arranged at right angles to said first and second axes, said cylindrical work tube forming rollers thereby being provided with means for movement along a plurality of arcuate stroking paths between proximal, distal, and radially inwardly and outwardly disposed end points relative to said tubular axis and with said arcuate paths traveling along one of a predetermined series of arcuately spaced-apart paths with certain successive arcuate paths of travel of said predetermined series converging upon said tubular axis toward the distal end point thereof; and (f) means for adjusting the arcuate spacing of successive strokes of motion wherein the arcuate spacing for each individual stroke of axial outwardly radially inwardly directed motion and the magnitude of force applied to said forming rollers is selectively different from its preceding axially inwardly radially outwardly directed stroke, the arrangement being such that the motion applied to said forming rollers during a substantial portion of said axially inwardly radially outwardly directed arcuate strokes is controllably related to that of its immediate preceding axially outwardly radially inwardly directed arcuate stroke by always being greater than, less than, or equal to that of said immediately preceding axially outwardly radially inwardly directed arcuate stroke.

* * * * *